US010561241B2

(12) United States Patent
Albarran et al.

(10) Patent No.: US 10,561,241 B2
(45) Date of Patent: Feb. 18, 2020

(54) ADJUSTABLE DRIP TRAY ASSEMBLY FOR GRAVITY-FED DISPLAY SYSTEM

(71) Applicant: B-O-F CORPORATION, Aurora, IL (US)

(72) Inventors: Edwin Albarran, Chicago, IL (US); Julio Rubio, Joliet, IL (US); Joseph Coretti, Jr., Wheaton, IL (US)

(73) Assignee: B-O-F CORPORATION, Aurora, IL (US)

( * ) Notice: Subject to any disclaimer, the term of this patent is extended or adjusted under 35 U.S.C. 154(b) by 0 days.

(21) Appl. No.: 16/175,551

(22) Filed: Oct. 30, 2018

(65) Prior Publication Data

US 2019/0150615 A1 May 23, 2019

Related U.S. Application Data

(60) Provisional application No. 62/579,635, filed on Oct. 31, 2017.

(51) Int. Cl.
*A47B 96/02* (2006.01)
*A47F 5/00* (2006.01)
(Continued)

(52) U.S. Cl.
CPC ..... *A47B 96/021* (2013.01); *A47B 96/07* (2013.01); *A47F 3/004* (2013.01); *A47F 3/0465* (2013.01); *A47F 5/0025* (2013.01); *A47F 5/0068* (2013.01); *A47F 1/04* (2013.01); *A47F 1/08* (2013.01); *A47F 2003/066* (2013.01)

(58) Field of Classification Search
CPC ..... A47F 3/004; A47F 3/0465; A47F 5/0025; A47F 5/0068; A47F 1/04; A47F 1/08; A47F 2003/066; A47F 3/06; A47F 3/12; A47F 3/063; A47F 3/142; A47F 5/0043; A47F 5/0062; A47F 2005/0075; A47F 5/0081; A47F 5/16; A47F 2005/165; A47F 1/00; A47F 3/00; A47B 96/02; A47B 96/021; A47B 96/025; A47B 96/06; A47B 96/063;
(Continued)

(56) References Cited

U.S. PATENT DOCUMENTS 3,295,634 A * 1/1967 Bucbbinder ..... A47F 3/0486 186/54
3,628,807 A * 12/1971 Fullington ..... A47F 5/135 280/79.3

(Continued)

*Primary Examiner* — Jennifer E. Novosad
(74) *Attorney, Agent, or Firm* — Marshall, Gerstein & Borun LLP

(57) ABSTRACT

An adjustable drip tray assembly for a rack of a gravity-fed display shelf. The adjustable drip tray assembly includes a pair of clip assemblies attached to the rack, each clip assembly having a body with a base, a front end, and a rear end. A projecting bracket is coupled to the front end, an adjustable bracket is disposed between the front and rear ends of the body, and a spacing bracket is disposed near the rear end. The adjustable bracket includes a longitudinal slot and a spring nut disposed within the longitudinal slot and into a receiving member to secure the adjustable bracket to the body. A drip tray includes ends disposed on the pair of clip assemblies, the pair of clip assemblies supporting and adjustably securing the drip tray to the rack and spacing the drip tray from the rack.

20 Claims, 8 Drawing Sheets

(51) Int. Cl.

| | |
|---|---|
| ***A47F 3/00*** | (2006.01) |
| ***A47F 3/04*** | (2006.01) |
| ***A47B 96/07*** | (2006.01) |
| ***A47F 1/04*** | (2006.01) |
| ***A47F 3/06*** | (2006.01) |
| ***A47F 1/08*** | (2006.01) |

(58) Field of Classification Search

CPC ... A47B 96/065; A47B 96/066; A47B 96/068; A47B 96/07

USPC ..... 211/183, 59.2, 189, 134; 248/200, 214, 248/215

See application file for complete search history.

(56) References Cited

U.S. PATENT DOCUMENTS 4,200,993 A * 5/1980 Blanc ..... A43D 3/1491 211/34
4,519,508 A * 5/1985 Gullett ..... A47B 57/04 108/107
4,799,744 A * 1/1989 Toy ..... A47J 47/16 211/184
4,809,855 A * 3/1989 Bustos ..... A47F 1/12 211/150
5,109,990 A * 5/1992 Murphy ..... A47J 47/20 211/41.3
5,285,906 A * 2/1994 Wisnowski ..... A63C 11/028 211/62
5,490,600 A * 2/1996 Bustos ..... A47B 57/00 211/187
5,607,068 A * 3/1997 Coretti, Jr. ..... A47F 5/135 211/59.2
5,884,784 A * 3/1999 Betts, Sr. ..... B01L 9/00 206/278
5,953,931 A * 9/1999 Brittain ..... F25D 21/14 220/371
5,984,249 A * 11/1999 Cohen ..... A47G 7/044 108/47
6,729,484 B2 * 5/2004 Sparkowski ..... A47F 5/137 211/134
6,880,708 B2 * 4/2005 Boron ..... A47F 1/12 211/188
7,316,378 B1 * 1/2008 Curran ..... A47F 5/0068 248/298.1
7,766,174 B2 * 8/2010 Abraitis ..... A47L 23/20 211/36
8,020,714 B2 * 9/2011 Miller, Jr. ..... A47F 3/0404 108/107
8,251,233 B1 * 8/2012 Biglow ..... A47F 5/101 211/187
9,357,840 B2 * 6/2016 Davis ..... A47B 57/04
2006/0076304 A1 * 4/2006 Kainuma ..... A47F 3/00 211/90.01
2011/0114578 A1 * 5/2011 Jacobs ..... A47F 1/12 211/59.2
2011/0309043 A1 * 12/2011 Kaiser ..... A47F 5/005 211/59.2
2019/0150615 A1 * 5/2019 Albarran ..... A47B 96/021

* cited by examiner

ADJUSTABLE DRIP TRAY ASSEMBLY FOR GRAVITY-FED DISPLAY SYSTEM

CROSS-REFERENCE TO RELATED APPLICATIONS

This application claims the benefit of the filing date of U.S. Provisional Patent Application No. 62/579,635, filed Oct. 31, 2017, the entirety of which is hereby incorporated by reference.

FIELD OF THE DISCLOSURE

The disclosure relates generally to gravity-fed display systems, and, more specifically, to an adjustable drip tray assembly for a gravity-fed rack or a gravity-fed display system.

BACKGROUND OF THE DISCLOSURE

To increase inventory turnover and maximize efficient use of shelf space, retailers increasingly use gravity flow shelving systems or gravity-fed display systems having inclined wire shelves that are used to stock merchandise. In such systems, consumers are typically presented with an array of merchandise arranged in parallel tracks on each shelf, generally with only the front-most unit of merchandise in each individual track being easily accessible. Upon removing this front-most unit of merchandise, the remaining units of like-merchandise in that particular track advance, i.e., slide down toward the front of the shelf, allowing the next-successive unit in line to become the new front-most unit in that track.

In one example, the gravity-fed display system includes a rack having the wire shelves for supporting milk cartons or other beverage cartons. The conventional rack uses a tray that extends the entire depth of the rack and is disposed under the lowest shelf of the rack for catching any excess liquid or spillage from the milk or other beverage cartons disposed on the shelves. This conventional rack, however, is difficult to remove and drain without spilling. In addition, in still other conventional gravity-fed display systems, a front portion of the shelves disposed on the rack often nearly contact a front area of a door of refrigerated cooler upon placement in the cooler. Having the shelves so close and/or nearly contacting the cooler door increases the difficulty of a user removing product, such as a milk carton, from the shelf in a smooth and easy manner.

SUMMARY OF THE DISCLOSURE

In accordance with a first exemplary aspect of the present disclosure, an adjustable drip tray assembly for a gravity-fed display system is disclosed. The adjustable drip tray assembly comprises a pair of clip assemblies, and each clip assembly is adapted to be attached to a portion of a rack of the gravity-fed display system. In addition, each clip assembly has a body with a base having front end, a rear end, a pair of side walls disposed on either side of the base between the front and rear ends, a first receiving member attached to the base near the front end of the body, and a second receiving member attached to the base between the front and rear ends of the body. In addition, each clip assembly also includes a downwardly projecting bracket coupled to the front end of the body and having a through-hole and a first spring nut disposed within the through-hole and into the first receiving member to secure the projecting bracket to the body. An adjustable bracket is disposed near the front end of the body and adjacent to the downwardly projecting bracket. The adjustable bracket includes a longitudinal slot and a second spring nut disposed within the longitudinal slot and into the second receiving member to secure the adjustable bracket to the body. In addition, a spacing bracket is disposed near the rear end of the body and spaced from the adjustable bracket. The spacing bracket has an aperture and a third spring nut disposed within the aperture to secure the spacing bracket to the body. A drip tray has ends disposed on the pair of clip assemblies, such that a first end of the drip tray is disposed within the adjustable bracket of a first clip assembly of the pair of clip assemblies and the second end of the drip tray is disposed within the adjustable bracket of a second clip assembly of the pair of clip assemblies. So configured, the pair of clip assemblies support and adjustably secure the drip tray to the rack.

According to another exemplary aspect of the present disclosure, a gravity-fed display system is disclosed. The gravity-fed display system comprises a rack having front support legs, rear support legs disposed opposite the front support legs, and at least one lower front strut disposed between the front support legs. In addition, at least one display shelf is disposed within the rack above the at least one lower front strut, and an adjustable drip tray assembly is attached to the at least one lower front strut below the at least one display shelf. The adjustable drip tray assembly comprises a pair of clip assemblies, and each clip assembly is attached to the at least one lower front strut. Further, each clip assembly includes a body with a base having front end, a rear end, a first receiving member attached to the base near the front end, and a second receiving member attached to the base between the front and rear ends. A projecting bracket is coupled to the front end of the body and has a through-hole and a first spring nut disposed within the through-hole and into the first receiving member to secure the projecting bracket to the body. An adjustable bracket is disposed between the front and rear ends of the body and has a longitudinal slot and a second spring nut disposed within the longitudinal slot and into the second receiving member to secure the adjustable bracket to the body. Further, a spacing bracket is disposed near the rear end of the body and has an aperture and a third spring nut disposed within the aperture to secure the spacing bracket to the body. A drip tray has ends disposed on the pair of clip assemblies, such that the pair of clip assemblies support and adjustably secure the drip tray to the rack.

According to a further exemplary aspect of the present disclosure, a method of supporting a drip tray of a gravity-fed display system is disclosed. The method comprises attaching a first clip assembly of an adjustable drip tray assembly to a first end of a lower strut of a rack of the gravity-fed display system, and attaching a second clip assembly of the adjustable drip tray assembly to a second end of the lower strut of the rack of the gravity-fed display system. The method further comprises one or more of setting or adjusting a position of an adjustable bracket of one or more of the first clip assembly or the second clip assembly. The method also comprises disposing a first end of a drip tray within the adjustable bracket of the first clip assembly, and disposing a second end of the drip tray within the adjustable bracket of the second clip assembly, the first and second clip assemblies of the adjustable drip tray assembly supporting and adjustably securing the drip tray to the rack.

In further accordance with any one or more of the exemplary aspects, an assembly, a system and/or a method of this disclosure may optionally include any one or more of the following preferred forms.

In some preferred forms, each clip assembly may be adapted to be attached a lower, front strut of the rack, to which at least one caster assembly may also be attached. In addition, the spacing bracket of each clip assembly may be adapted to be nested between a pair of lower front struts of the rack, and each strut of the pair of lower front struts may have a first end and a second end. The first clip assembly may be adapted to be attached to the first end of each lower, front strut and the second clip assembly may be adapted to be attached to the second end of each lower, front strut. Further, the downwardly projecting bracket may be an L-shaped bracket having a body and a projection downwardly extending from the body, such that the projection is a bumper disposed below and in front of the drip tray. In addition, the adjustable bracket may be a U-shaped bracket and may include a base with the longitudinal slot disposed within the base, and a side wall upwardly extending from each end of the base, the side walls contacting the drip tray to secure the drip tray within the clip assembly. The second spring nut may be disposed in any position along the length of the longitudinal slot of the adjustable bracket, including one of a front area, a rear area or any other area disposed between the front and rear areas of the longitudinal slot. So configured, this enables a position of the adjustable bracket on the body of the clip assembly to be easily adjusted. Still further, the spacing bracket may include a base having the aperture, and a side wall upwardly extending from each end of the base. Each side wall may include an outwardly extending flange, and each outwardly extending flange may be adapted to contact a strut of the rack when the clip assembly is attached to the rack.

In other preferred forms, the at least one lower, front strut may include a pair of lower, front struts, and each strut may have a first end and a second end. In addition, the system may further comprise a first caster assembly attached to the first end of the at least one lower front strut and a second caster assembly attached to the second end of the at least one lower front strut. Further, each clip assembly may be attached to the at least one lower, front strut of the rack, to which at least one caster assembly may also be attached.

In still other preferred forms, attaching the first clip assembly to the first end of the lower strut of the rack or attaching the second clip assembly to the second end of the lower strut may comprise nesting a spacing bracket of each of the first and second clip assemblies between a pair of lower struts of the rack. In addition, one or more of setting or adjusting the position of the adjustable bracket of one or more of the first clip assembly or the second clip assembly may comprise disposing a spring nut within any position along a length of a longitudinal slot of the adjustable bracket and into a receiving member attached to a base of the body of one or more of the first and second clip assemblies to secure the bracket to the body. The position along the length of the longitudinal slot may include one of a front area, a rear area, or any other position disposed between the front and rear areas of the longitudinal slot. Further, the method may comprise attaching a caster assembly to the first end of the lower strut of the rack and a second caster assembly to the second end of the lower strut of the rack. Still further, disposing the drip tray within the adjustable bracket may comprise disposing the drip tray onto a spring nut disposed within a longitudinal slot of the adjustable bracket on the body of each of the first and second clip assemblies, securing the drip tray to the adjustable bracket during movement of the rack.

BRIEF DESCRIPTION OF THE SEVERAL VIEWS OF THE DRAWINGS

The Figures described below depict various aspects of the system and methods disclosed therein. It should be understood that each figure depicts an example of a particular aspect of the disclosed system and methods, and that each of the figures is intended to accord with a possible example thereof. Further, wherever possible, the following description refers to the reference numerals included in the following figures, in which features depicted in multiple figures are designated with consistent reference numerals.

DETAILED DESCRIPTION OF THE DISCLOSURE

The present disclosure is directed generally to an adjustable drip tray assembly for a gravity-fed display system adapted to receive and display milk cartons and the like in a gravity-fed manner. In one example, the adjustable drip tray assembly includes a pair of clip assemblies, and each clip assembly is attached to a lower, front portion of a rack of the gravity-fed display system. Each clip assembly includes a body having a front end, a rear end and a pair of side walls disposed between the front and rear ends. An adjustable bracket is disposed on the body near the front end of the body and includes a longitudinal slot in which a spring nut is disposed to secure the adjustable bracket to the body of the clip assembly. A drip tray includes a first end disposed within the adjustable bracket of one clip assembly of the pair of clip assemblies and a second end disposed within the adjustable bracket of the other clip assembly of the pair of clip assemblies. So configured, the pair of clip assemblies support and adjustably secure the drip tray to the front portion of the rack of the gravity-fed display system, making removal, cleaning, and replacement of the drip tray significantly easier than conventional drip trays spanning the entire bottom of the rack, for example.

Figure 1:
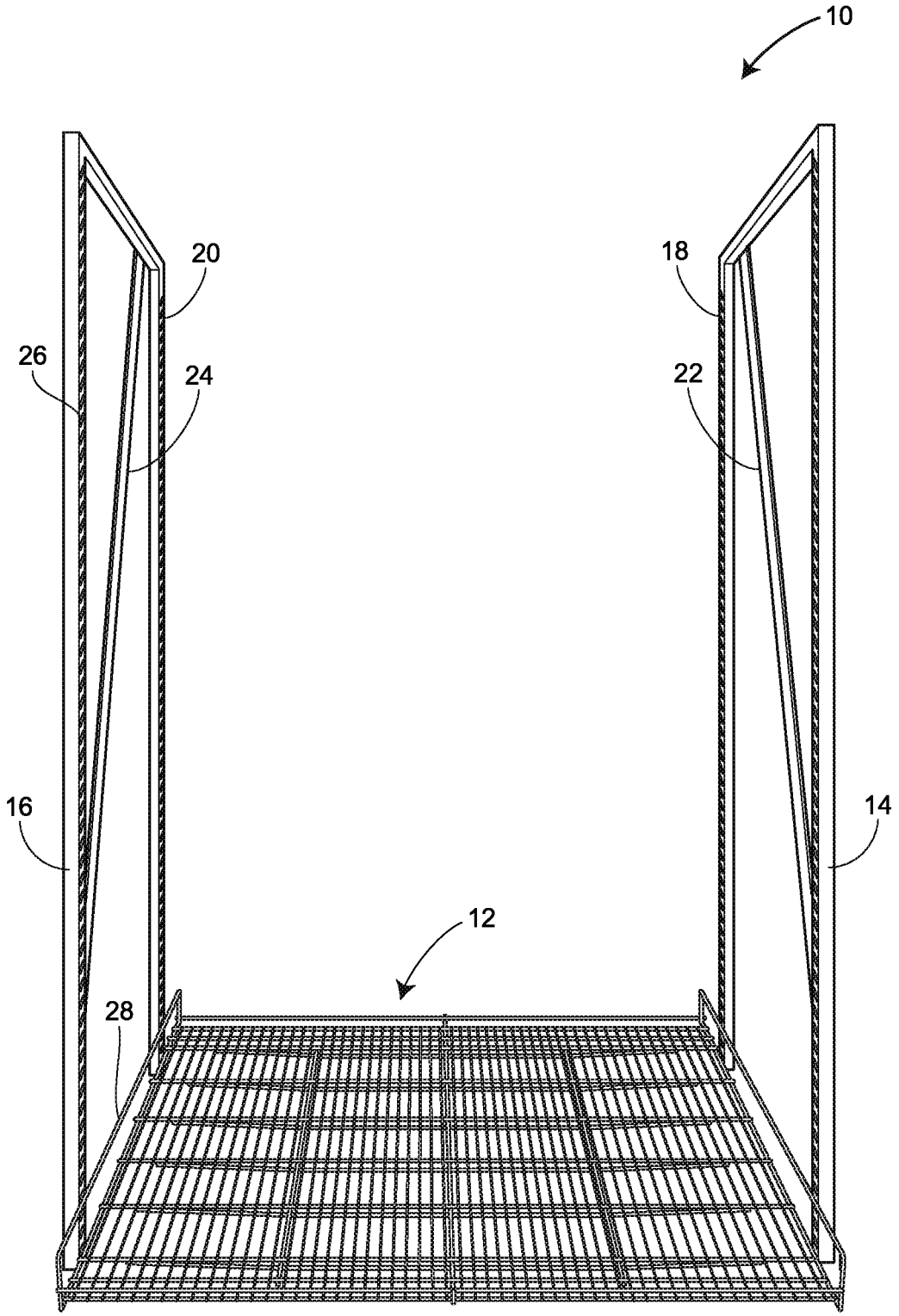
FIG. 1 is a front, perspective view of a conventional rack of a gravity-fed display system illustrating an exemplary display shelf disposed therein, the gravity-fed display system adapted to be used with an adjustable drip tray assembly of the present disclosure.

More specifically, and referring now to FIG. 1, a gravity-fed display system 10 is illustrated. The gravity-fed display system 10 includes a preferably metal rack 12 having two front support legs 14, 16 and two rear support legs 18, 20 disposed opposite the front support legs 14, 16. The rack 12 may further include two diagonal stabilizer support rack members 22, 24. To customize the assembly of the gravity-fed display system 10, each of the legs 14, 16, 18 and 20 is provided with holes 26, such as key holes, along its length. The holes 26 enable one or more display shelves 28 to be placed at any desired height and angle of incline along the legs 14, 16, 18 and 20 to maximize storage space, for example. The holes may be keyhole slots that receive clamps (not shown), such as the shelf clamp of U.S. Des. 705,044, owned by the assignee of the present invention, for example.

Figure 2:
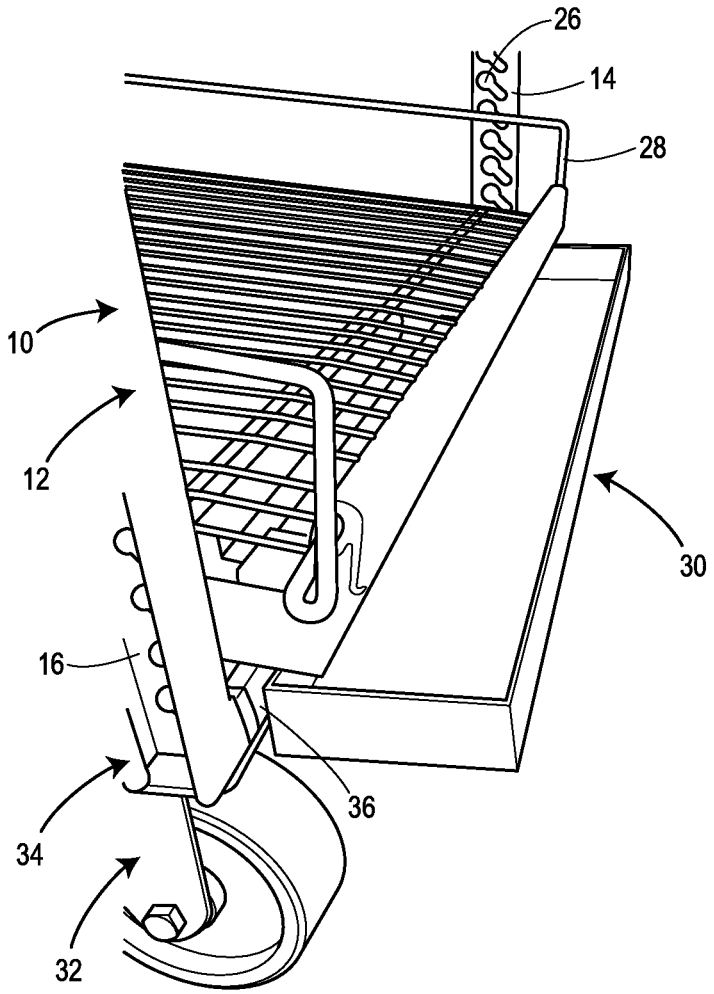
FIG. 2 is side, perspective view of an adjustable drip tray assembly of the present disclosure coupled to a gravity-fed display system.
Figure 3:
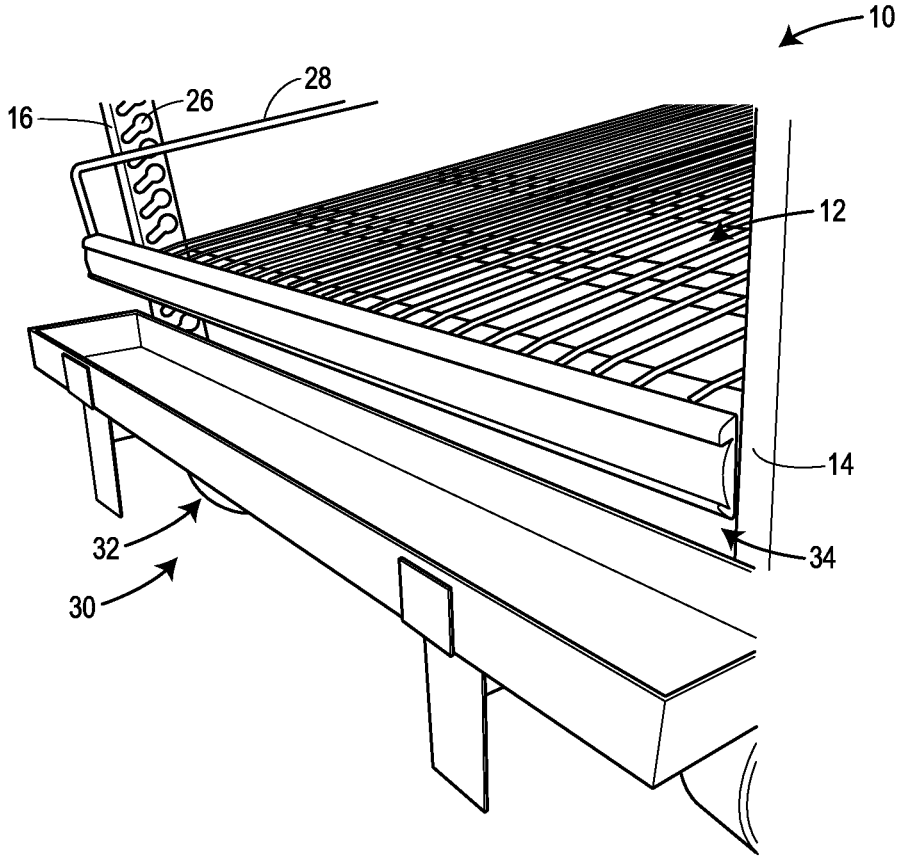
FIG. 3 is a perspective view of the adjustable drip tray assembly of FIG. 2.

Referring now to FIGS. 2 and 3, an adjustable drip tray assembly 30 of the present disclosure is attached to the gravity-fed display system 10. In particular, a lower, front portion of the gravity-fed display system 10 is depicted in FIG. 2. The shelf 28 is attached to the front legs 14, 16 of the rack 12 via the key holes 26 disposed within each leg 14, 16, as depicted relative to the leg 14, for example. The adjustable drip tray assembly 30 is attached to a lower, front portion of the rack 12, as described more below. So configured, the adjustable drip tray assembly 30 is disposed below the shelf 28 to catch any excess liquid or materials from the shelf 28, for example. As further depicted, at least one caster assembly 32 is also attached to the rack 12, such as a lower front portion 34 of the rack 12, to enable the rack 12 to be easily moved into and/or within a refrigerated space, to stock, clean and/or restock the shelves 28 of the rack 12, for example.

As depicted in FIG. 2, for example, the rack 12 may also include at least one strut 36, such as a lower front strut, disposed between the front legs 14 and 16. The display shelf 28 is disposed within the rack 12 above the at least one lower front strut 36, and the adjustable drip tray assembly 30 is attached to the at least one lower front strut 36, as described more below.

Figure 4:
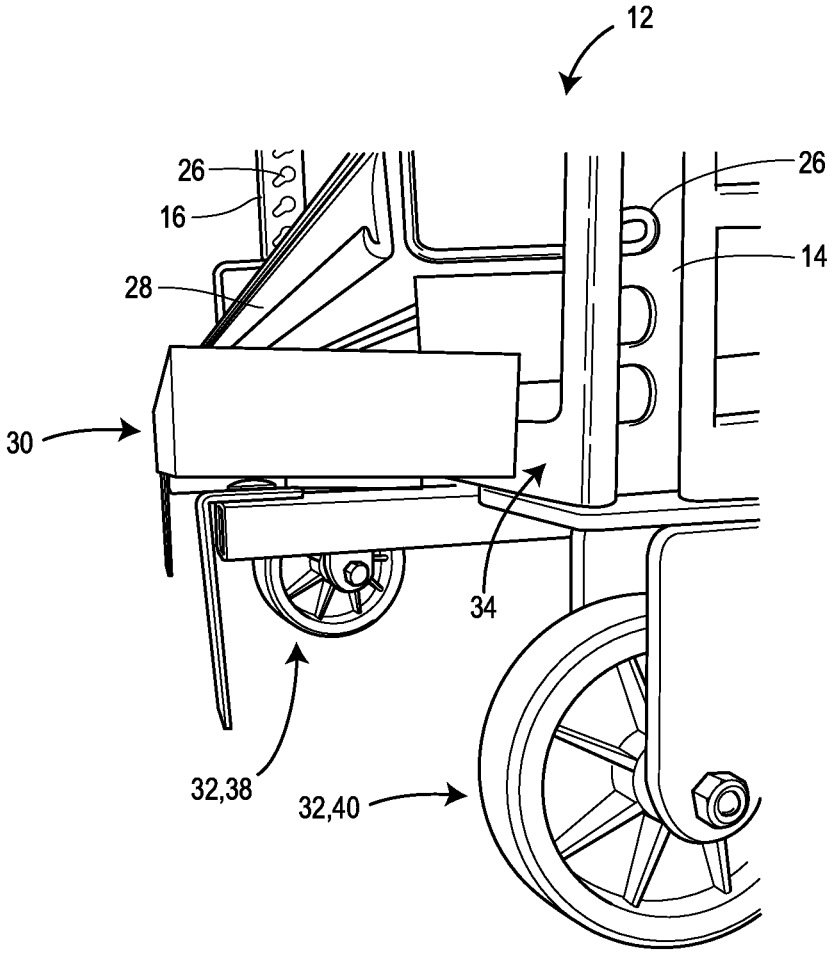
FIG. 4 is another side, perspective view of the adjustable drip tray assembly of FIG. 3.

Referring now to FIG. 4, a side, perspective view of the adjustable drip tray assembly 30 attached to the rack 12 is depicted. As further depicted, a pair of caster assemblies 32 may be attached to the rack, such as the lower front portion 34 of the rack 12, to enable the rack 12 to be easily moved within an area. While not depicted, one of ordinary skill in the art will appreciate that a second pair of caster assemblies may also be included below the rear legs 18, 20 (FIG. 1) of the rack 12 to balance the pair of caster assemblies 32 disposed below the front legs 14, 16 at the lower front portion 34 of the rack, for example. In one example, the pair of caster assemblies 32 includes a first caster assembly 38 disposed below the front leg 16 and a second caster assembly 40 disposed below the front leg 14.

Figure 5:
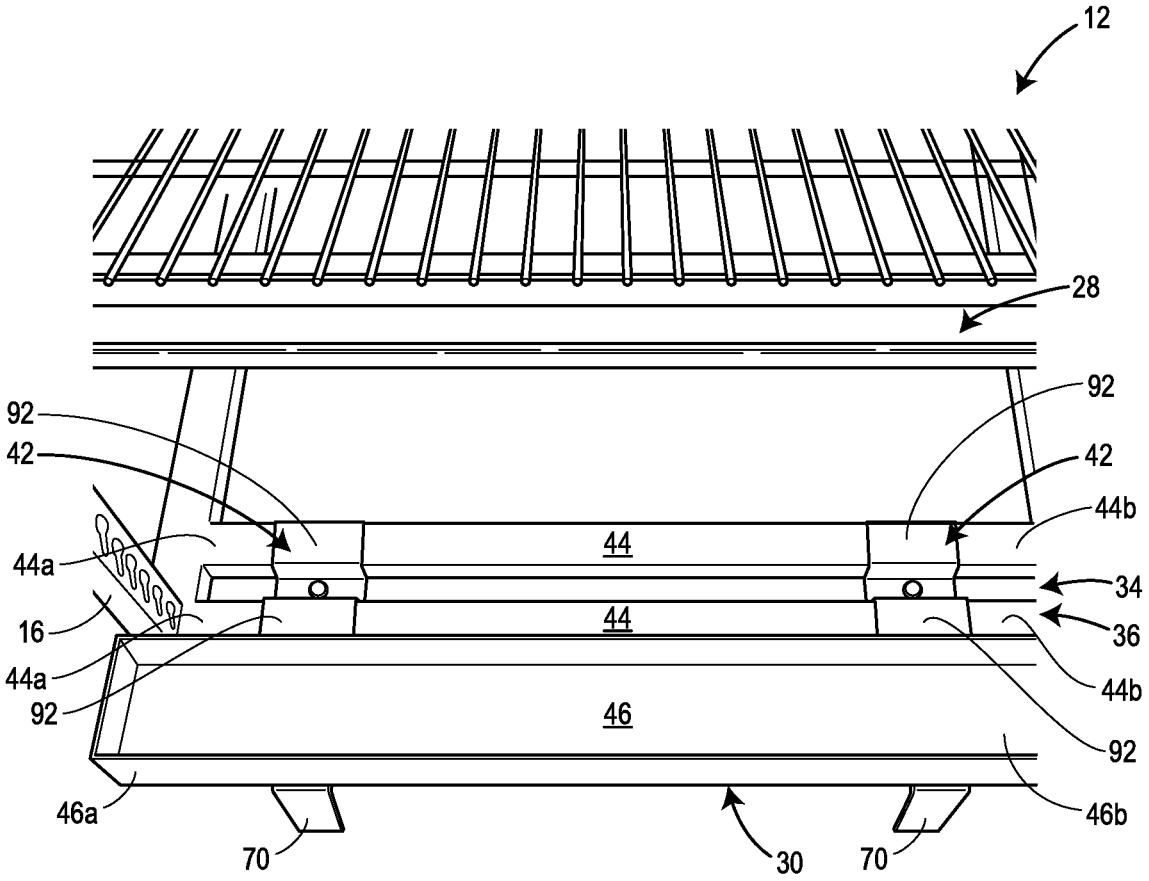
FIG. 5 is top, perspective view of the adjustable drip tray assembly of the present disclosure.

Referring now to FIG. 5, the adjustable drip tray assembly 30 includes a pair of clip assemblies 42, each of which is attached to the at least one lower front strut 36. In one example, the at least one lower front strut 36 includes a pair of lower front struts 44, each lower front strut 44 of the pair of struts having a first end 44*a* and a second end 44*b* disposed opposite the first end 44*a*. The adjustable drip tray assembly 30 further includes a drip tray 46 having a first end 46*a* and a second end 46*b*. The first and second ends 46*a*, 46*b* of the drip tray 46 are disposed on and/or within a portion of each clip assembly 42, such that the pair of clip assemblies 42 support and adjustably secure the drip tray 46 to the rack 12.

Figure 6:
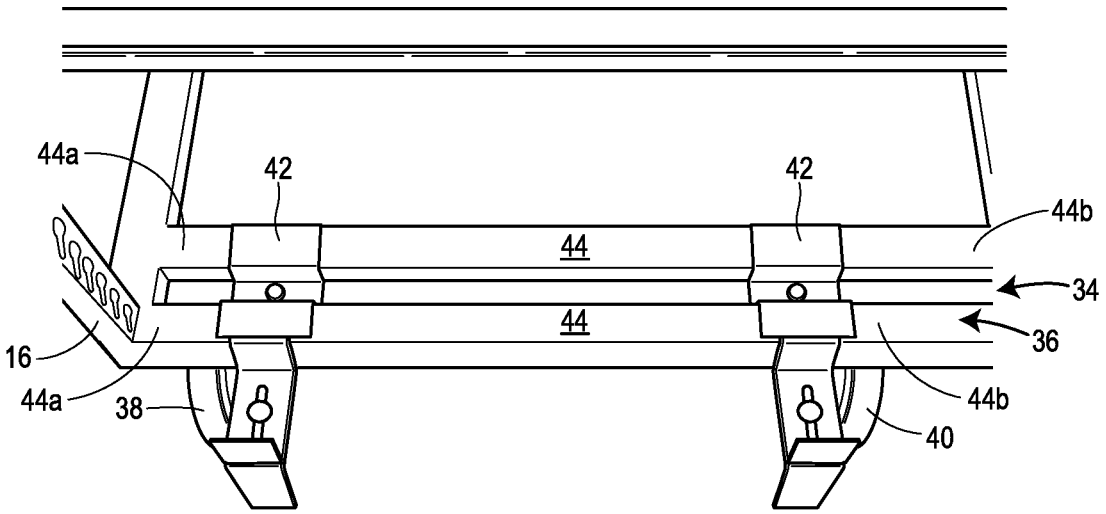
FIG. 6 is another top, perspective view of the adjustable drip tray assembly of the present disclosure having a drip tray of the adjustable drip tray assembly removed.

As depicted in FIG. 6, the drip tray 46 may be easily removed from the pair of clip assemblies 42 to remove any liquid and/or clean the drip tray 46 after use. Moreover, the first caster assembly 38 may be attached to the first end 44*a* of the at least one strut 44 of the pair of lower front struts 44 via the clip assembly 42. In addition, the second caster assembly 40 may be attached to the second end 44*b* of the at least one strut 44 of the pair of lower front struts 44 via the other clip assembly 42 of the pair of clip assemblies 42, as also described more below.

Figure 7:
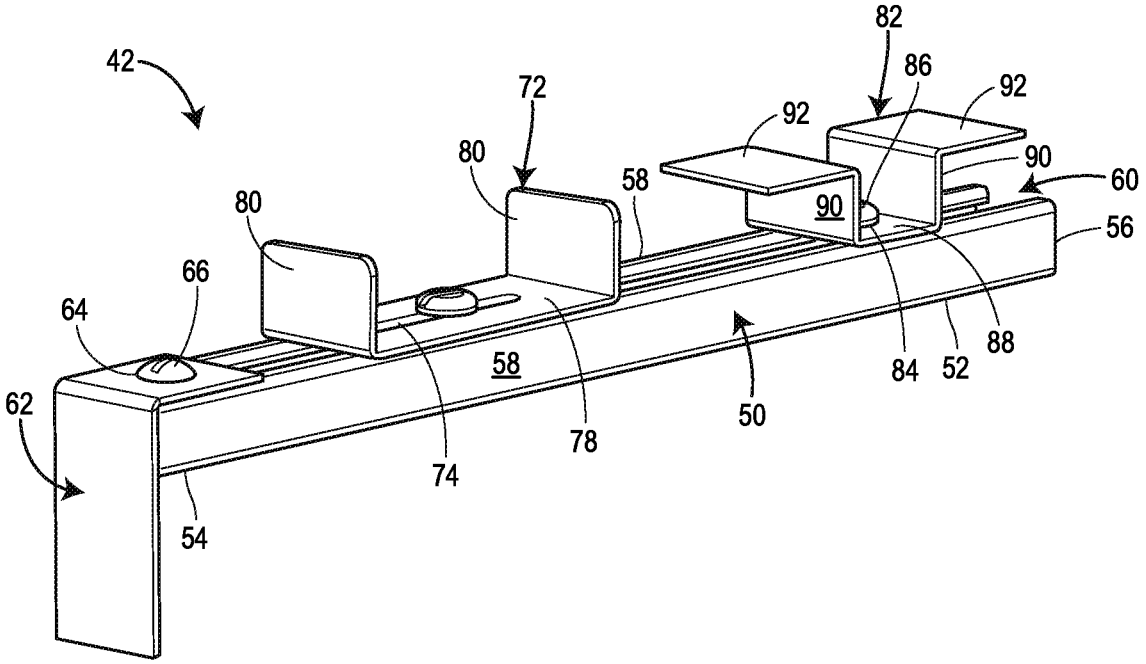
FIG. 7 is a perspective view of a clip assembly of the adjustable drip tray assembly.
Figure 8:
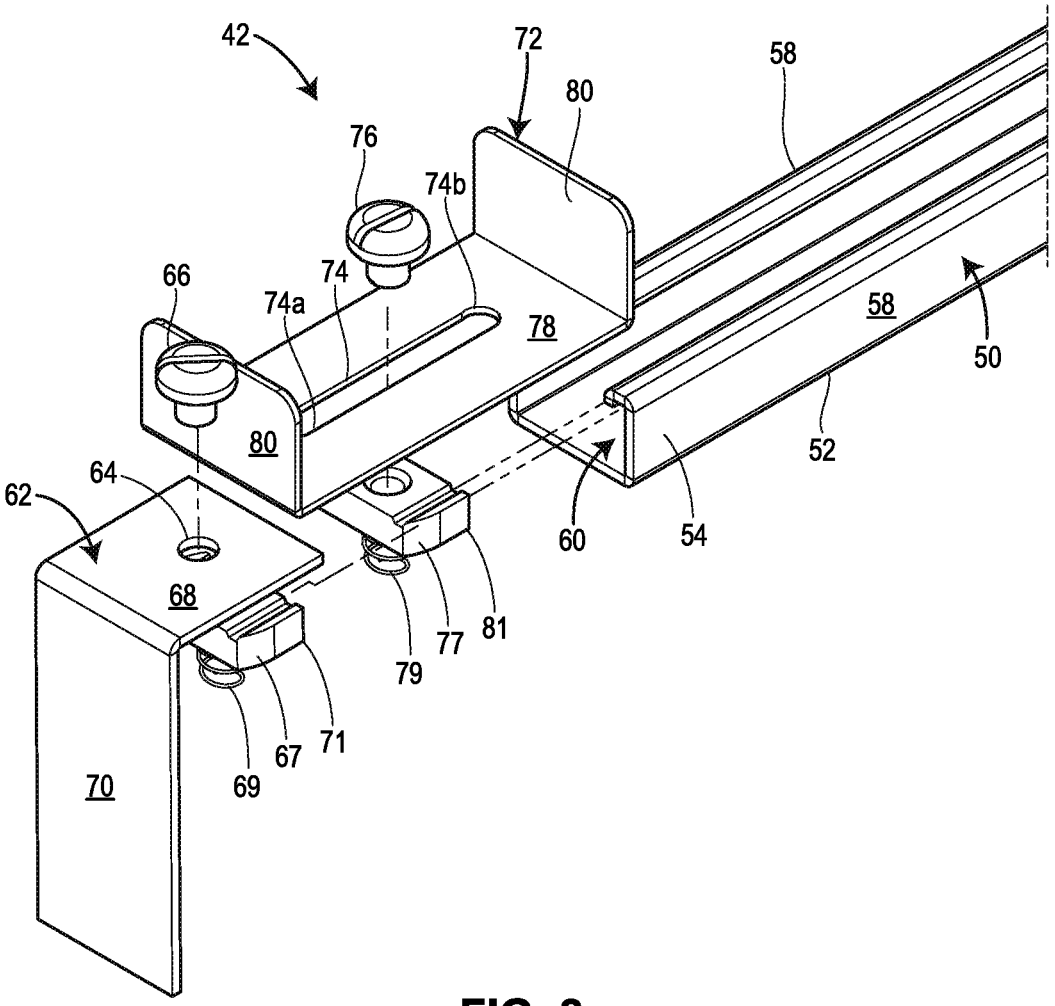
FIG. 8 is an exploded view of a portion of the clip assembly of the adjustable drip tray assembly of the present disclosure.

Referring now to FIGS. 7 and 8, one clip assembly 42 of the pair of clip assemblies 42 of the adjustable drip tray assembly 30 is depicted. Each clip assembly 42 includes a body 50 having a base 52 with a front end 54, a rear end 56, and a pair of side walls 58 disposed on either side of the base 52 between the front and rear ends 54, 56. A recess 60 is disposed between the pair of side walls 58.

In addition, a downwardly projecting bracket 62 is coupled to the front end 54 of the body 50. The projecting bracket 62 includes a through-hole 64 and a spring nut 66 disposed within the through-hole 64 and into a first receiving member 67 attached to the base 52 at the front end 54 of the body to secure the projecting bracket 62 to the body 50. More specifically, the first receiving member 67 includes a spring 69 (FIG. 8) having one end attached to the base 52 and the other end attached to an underside 71 of the first receiving member 67. So configured, the downwardly projecting bracket 62 is spring-loaded when attached to the body 50 via the spring nut 66 and first receiving member 67.

In one example, the projecting bracket 62 may be an L-shaped bracket having a body 68 and a projection 70 (FIG. 8) downwardly extending from the body 68. So configured, the projection 70 is a bumper disposed below and in front of the drip tray 46, as depicted in FIG. 5, for example. As one of ordinary skill in the art will appreciate, the projecting bracket 62 may alternatively and/or additionally take the form of various other shapes different from the L-shaped bracket, for example, and still fall within the scope of the present disclosure.

Each clip assembly 42 further includes an adjustable bracket 72 disposed near the front end 54 of the body 50 and adjacent to the projecting bracket 62. In one example, the adjustable bracket 72 is a U-shaped bracket. As one of ordinary skill in the art will appreciate, the adjustable bracket 72 may alternatively and/or additionally take the form of various other shapes different from the U-shaped bracket, for example, and still fall within the scope of the present disclosure. The adjustable bracket 72 has a longitudinal slot 74 and a spring nut 76 disposed within the longitudinal slot 74 and into a second receiving member 77 attached to a center area of the base 52 of the body 50 to secure the adjustable bracket 72 to the body 50. Like the first receiving member 67, the second receiving member 77 also includes a spring 79 (FIG. 8) having one end attached to the base 52 and the other end attached to an underside 81 of the second receiving member 77. So configured, the adjustable bracket is spring-loaded when attached to the body 50 via the spring nut 66 and second receiving member 77.

In one example, the adjustable bracket 72 includes a base 78 with the longitudinal slot 74 disposed within the base 78, and a side wall 80 extending from each end of the base 78. The side walls 80 contact the drip tray 46 when disposed on the clip assemblies 42 to secure and maintain the drip tray 46 within each clip assembly 42. The longitudinal slot 74 allows the spring nut 76 to be disposed along any position within the longitudinal slot 74 along the length of the longitudinal slot 74. For example, depending upon the desired position of the Adjustable bracket 72, and, thus, the drip tray 46 disposed within the adjustable brackets 72, the spring nut 76 may be disposed within a center area of the longitudinal slot 74, as depicted in FIG. 7. Alternatively, the spring nut 76 may be disposed at a front area 74*a* of the longitudinal slot 74, a rear area 74*b* of the longitudinal slot 74, or any other position disposed between the front and rear areas 74*a*, 74*b* of the longitudinal slot 74 along the length of the longitudinal slot 74. This flexibility and easy adjustability relative to the position of the spring nut 76 of the adjustable bracket 72 enables the position of the adjustable bracket 72 of each clip assembly 42 to be easily adjusted, which in turn allows the drip tray 46 disposed in the adjustable brackets 72 when the adjustable drip tray assembly 30 is coupled to the rack 12 to be also be easily adjusted, removed, and/or cleaned as need.

Each clip assembly 42 also includes a spacing bracket 82 disposed near the rear end 56 of the body 50 and spaced from the adjustable bracket 72. The spacing bracket 82 includes an aperture 84 and a spring nut 86 disposed within the aperture 84 and into another receiving member (not depicted) to secure the spacing bracket 82 to the body 50, for example. Like the first and second receiving members 67, 77 described above, the receiving member into which the spring nut 86 of the spacing bracket 82 is inserted in also attached to the base 52 of the body 50 of each clip assembly 42 at the rear end 56 of the body 52. One end of a spring is attached to the base 52 at this location and the other end of the spring is attached to an underside of this receiving member. So configured, the spacing bracket 82 is also spring-loaded when attached to the body 50 via the spring nut 86 and receiving member.

In one example, the spacing bracket 82 includes a base 88 having the aperture 84 and a side wall 90 extending from each end of the base 88. Each side wall 90 further includes an outwardly extending flange 92 contacting at least one strut 44 of the rack 12, as depicted in FIG. 5, for example. More specifically, the spacing bracket 82 is nested between the pair of lower, front struts 44 of the rack 12, as further depicted in FIG. 5. In this example, one clip assembly 42, such as a first clip assembly, of the pair of clip assemblies is attached to the first end 44*a* of the struts 44 and the other clip assembly 42, such as a second clip assembly, of the pair of clip assemblies, is attached to the second end 44*b* of the struts 44. Said another way, the spacing bracket 82 of the first clip assembly 42 is nested between the front struts 44 of the rack 12 at the first ends 44*a* of the struts 44. Likewise, spacing bracket 82 of the second clip assembly 42 is nested between the front struts 44 of the rack 12 at the second ends 44*b* of the struts 44.

In view of the foregoing, one of ordinary skill in the art will appreciate the following example method of supporting the drip tray 46 of the gravity-fed display system 10. More specifically, the method includes attaching the first clip assembly 42 of the adjustable drip tray assembly 30 to the first end 44*a* of the lower, front strut 44 of the rack 12 of the gravity-fed display system 10. The method may also include attaching the second clip assembly 42 of the pair of clip assemblies 42 of the adjustable drip tray assembly 30 to the second end 44*b* of the lower, front strut 44 of the rack 12 of the gravity-fed display system 10. The method may still further include one or more of setting or adjusting a position of the adjustable bracket 72 of one or more of the first clip assembly 42 or the second clip assembly 42, the adjustable bracket 72 for receiving the drip tray 46.

The method may still further include disposing the first end 46*a* of the drip tray 46 within the adjustable bracket 72 of the first clip assembly 42. Still further, the method may include disposing the second end 46*b* of the drip tray 46 within the adjustable bracket 72 of the second clip assembly 42, the first and second clip assemblies 42 of the adjustable drip tray assembly 30 supporting and adjustably securing the drip tray 46 to the rack 12.

In some examples, attaching the first clip assembly 42 to the first end 44*a* of the lower strut 44 of the rack 12 or attaching the second clip assembly 42 to the second end 44*b* of the lower strut 44 of the rack 12 may include nesting the spacing bracket 82 of each of the first and second clip assemblies 42 between a pair of the lower struts 44 of the rack 12. In other examples, one or more of setting or adjusting the position of the adjustable bracket 72 of one or more of the first clip assembly 42 or the second clip assembly 42 includes disposing the spring nut 76 within any position along a length of the longitudinal slot 74 of the adjustable bracket 72 and into the receiving member 77 (FIG. 8), such as the second receiving member 77, attached to the base 52 of the body 50 of one or more of the first and second clip assemblies 42 to secure the adjustable bracket 72 to the body 50. In this example, the position along the length of the longitudinal slot 74 may include one of the front area 74*a*, the rear area 74*b*, or any other position disposed between the front and rear areas 74*a*, 74*b* of the longitudinal slot 74.

In still other examples, the method may further include attaching the at least one caster assembly 32, such as the first caster assembly 38, to the first end 44*a* of the lower strut 44 of the rack 12 and another caster assembly 32, such as the second caster assembly 40, to the second end 44*b* of lower strut 44 of the rack 12. In addition, disposing the drip tray 46 within the adjustable bracket 72 may include disposing the drip tray 46 onto the spring nut 76 disposed within the longitudinal slot 74 of the adjustable bracket 72 on the body 50 of each clip assembly 42, securing the drip tray to the adjustable bracket 72 during movement of the rack 12.

The material of each of the body 50, the downwardly projecting bracket 62, the adjustable bracket 72, and the spacing bracket 82 of each clip assembly 42 may comprise aluminum or galvanized sheet metal, for example. One of ordinary skill in the art will understand that each of the body 50, the downwardly projecting bracket 62, the adjustable bracket 72, and the spacing bracket 82 may alternatively comprise various other materials capable of achieving the same functions as the one of aluminum and galvanized sheet metal and still fall within the scope of the present disclosure.

As one of ordinary skill in the art will further understand, the foregoing adjustable drip tray assembly 30 and method of supporting the drip tray coupled to the rack 12 of the gravity-fed display system includes several advantages. The drip tray 46 is much shorter than conventional drip trays previously spanning the entire width of a bottom shelf of the rack 12, for example, making removal and cleaning of the drip tray 46 significantly easier than conventional drip trays. In addition, the spring loaded, adjustable clip assemblies 42, in particular the adjustable brackets 72 of the clip assemblies 42, make removal, cleaning, and replacement of the drip tray 46 very easy. The clip assemblies 42 of the adjustable drip tray assembly 30 also space the drip tray 46 from the rack 12, which ultimately spaces the rack 12 from a front door of a refrigerated cooler, such as a couple inches from the front door. So configured, removal of product displayed on the shelf 28 of the rack 12 is easier to remove from the rack 12, for example.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "one example" or "an example" means that a particular element, feature, structure, or characteristic described in connection with the embodiment is included in at least one embodiment. The appearances of the phrase "in one example" in various places in the specification are not necessarily all referring to the same example.

Some examples may be described using the expression "coupled" and "connected" along with their derivatives. For example, some examples may be described using the term "coupled" to indicate that two or more elements are in direct physical or electrical contact. The term "coupled," however, may also mean that two or more elements are not in direct contact with each other, but yet still cooperate or interact with each other. The examples are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the description. This description, and the claims that follow, should be read to include one or at least one and the singular also includes the plural unless it is obvious that it is meant otherwise.

This detailed description is to be construed as examples and does not describe every possible embodiment, as describing every possible embodiment would be impractical, if not impossible. One could implement numerous alternate embodiments, using either current technology or technology developed after the filing date of this application.

While various embodiments have been described herein, it is understood that the appended claims are not intended to be limited thereto, and may include variations that are still within the literal or equivalent scope of the claims.

What is claimed is:

1. An adjustable drip tray assembly for a gravity-fed display system, the adjustable drip tray assembly comprising:

a pair of clip assemblies, each clip assembly adapted to be attached to a portion of a rack of the gravity-fed display system and having a body with a base having a front end, a rear end, a pair of side walls disposed on either side of the base between the front and rear ends, a first receiving member attached to the base near the front end of the body, and a second receiving member attached to the base between the front and rear ends of the body;

a downwardly projecting bracket coupled to the front end of the body and having a through-hole and a first spring nut disposed within the through-hole and into the first receiving member to secure the projecting bracket to the body;

an adjustable bracket disposed near the front end of the body and adjacent to the downwardly projecting bracket, the adjustable bracket having a longitudinal slot and a second spring nut disposed within the longitudinal slot and into the second receiving member to secure the adjustable bracket to the body;

a spacing bracket disposed near the rear end of the body and spaced from the adjustable bracket, the spacing bracket having an aperture and a third spring nut disposed within the aperture to secure the spacing bracket to the body; and a drip tray having ends disposed on the pair of clip assemblies, a first end of the drip tray disposed within the adjustable bracket of a first clip assembly of the pair of clip assemblies and the second end of the drip tray disposed within the adjustable bracket of a second clip assembly of the pair of clip assemblies, such that the pair of clip assemblies support and adjustably secure the drip tray to the rack.

2. The adjustable drip tray assembly of claim 1, wherein each clip assembly is adapted to be attached a lower, front strut of the rack, to which at least one caster is also attached.

3. The adjustable drip tray assembly of claim 1, wherein the spacing bracket of each clip assembly is adapted to be nested between a pair of lower front struts of the rack, each strut of the pair of lower front struts having a first end and a second end, and the first clip assembly adapted to be attached to the first end of each lower, front strut and the second clip assembly adapted to be attached to the second end of each lower, front strut.

4. The adjustable drip tray assembly of claim 1, wherein each downwardly projecting bracket is an L-shaped bracket having a body and a projection downwardly extending from the body, such that the projection is a bumper disposed below and in front of the drip tray.

5. The adjustable drip tray assembly of claim 1, wherein each adjustable bracket is a U-shaped bracket and includes a base with the longitudinal slot disposed within the base, and a side wall upwardly extending from each end of the base, the side walls contacting the drip tray to secure the drip tray within the respective clip assembly.

6. The adjustable drip tray assembly of claim 1, wherein each second spring nut is disposed in any position along the length of the longitudinal slot of the respective adjustable bracket, including one of a front area, a rear area or any other area disposed between the front and rear areas of the longitudinal slot, enabling a position of the adjustable bracket on the body of the respective clip assembly to be adjusted.

7. The adjustable drip tray assembly of claim 1, wherein each spacing bracket includes a base having the aperture, and a side wall upwardly extending from each end of the base, each side wall including an outwardly extending flange, each outwardly extending flange adapted to contact a strut of the rack when the clip assembly is attached to the rack.

8. A gravity-fed display system comprising:

a rack having front support legs, rear support legs disposed opposite the front support legs, and at least one lower front strut disposed between the front support legs;

at least one display shelf disposed within the rack above the at least one lower front strut; and an adjustable drip tray assembly attached to the at least one lower front strut below the at least one display shelf, the adjustable drip tray assembly comprising:

a pair of clip assemblies, each clip assembly attached to the at least one lower front strut and having:

a body with a base having a front end, a rear end, a first receiving member attached to the base near the front end and a second receiving member attached to the base between the front and rear ends;

a projecting bracket coupled to the front end of the body and having a through-hole and a first spring nut disposed within the through-hole and into the first receiving member to secure the projecting bracket to the body;

an adjustable bracket disposed between the front and rear ends of the body and having a longitudinal slot and a second spring nut disposed within the longitudinal slot and into the second receiving member to secure the adjustable bracket to the body; and a spacing bracket disposed near the rear end of the body and having an aperture and a third spring nut disposed within the aperture to secure the spacing bracket to the body; and a drip tray having ends disposed on the pair of clip assemblies, such that the pair of clip assemblies support and adjustably secure the drip tray to the rack.

9. The system of claim 8, wherein the at least one lower, front strut includes a pair of lower, front struts, each strut having a first end and a second end.

10. The system of claim 9, further comprising a first caster assembly attached to the first end of the at least one lower front strut and a second caster assembly attached to the second end of the at least one lower front strut.

11. The system of claim 9, wherein the spacing bracket of each clip assembly is nested between the pair of lower, front struts of the rack, and the first clip assembly is attached to the first end of each lower, front strut and the second clip assembly is attached to the second end of each lower, front strut.

12. The system of claim 8, wherein each clip assembly is attached to the at least one lower, front strut of the rack, to which at least one caster assembly is also attached.

13. The system of claim 8, wherein each projecting bracket is an L-shaped bracket having a body and a projection downwardly extending from the body, such that the projection is a bumper disposed below and in front of the drip tray.

14. The system claim 8, wherein each adjustable bracket is a U-shaped bracket and includes a base with the longitudinal slot disposed within the base, and a side wall upwardly extending from each end of the base, the side walls contacting the drip tray to secure and maintain the drip tray within the clip assembly.

15. The system of claim 8, wherein each second spring nut is disposed in any position along the length of the longitudinal slot of the adjustable bracket, including one of a front area, a rear area or any other area disposed between the front and rear areas of the longitudinal slot, enabling a position of the adjustable bracket on the body of the respective clip assembly to be adjusted.

16. The system claim 8, wherein each spacing bracket includes a base having the aperture, and a side wall upwardly extending from each end of the base, each side wall including an outwardly extending flange, each outwardly extending flange contacting the at least one strut of the rack.

17. A method of supporting a drip tray of a gravity-fed display system, the method comprising:

attaching a first clip assembly of an adjustable drip tray assembly to a first end of a lower strut of a rack of the gravity-fed display system;

attaching a second clip assembly of the adjustable drip tray assembly to a second end of the lower strut of the rack of the gravity-fed display system;

setting a position of each adjustable bracket of the first clip assembly and the second clip assembly;

disposing a first end of a drip tray within the adjustable bracket of the first clip assembly; and disposing a second end of the drip tray within the adjustable bracket of the second clip assembly, the first and second clip assemblies of the adjustable drip tray assembly supporting and adjustably securing the drip tray to the rack, wherein attaching the first clip assembly to the first end of the lower strut of the rack or attaching the second clip assembly to the second end of the lower strut comprises nesting a spacing bracket of each of the first and second clip assemblies between a pair of lower struts of the rack.

18. The method of claim 17, wherein setting the position of the adjustable bracket of the first clip assembly and the second clip assembly comprises disposing a spring nut within any position along a length of a longitudinal slot of each adjustable bracket and into a receiving member attached to a base of the body of one or more of the first and second clip assemblies to secure each adjustable bracket to the body, the position along the length of the longitudinal slot including one of a front area, a rear area, or any other position disposed between the front and rear areas of the longitudinal slot.

19. The method of claim 17, further comprising attaching a caster assembly to the first end of the lower strut of the rack and a second caster assembly to the second end of the lower strut of the rack.

20. The method of claim 17, wherein disposing the drip tray within the adjustable bracket comprises disposing the drip tray onto a spring nut disposed within a longitudinal slot of the adjustable bracket disposed on the body of each of the first and second clip assemblies, securing the drip tray to the adjustable bracket during movement of the rack.

* * * * *